US011332997B2

(12) United States Patent
Hitchcock

(10) Patent No.: US 11,332,997 B2
(45) Date of Patent: May 17, 2022

(54) DOWNHOLE DRILL-INJECT AND PLUG TOOL

(71) Applicant: SAUDI ARABIAN OIL COMPANY, Dhahran (SA)

(72) Inventor: Graham Hitchcock, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 81 days.

(21) Appl. No.: 17/009,011

(22) Filed: Sep. 1, 2020

(65) Prior Publication Data

US 2022/0065067 A1 Mar. 3, 2022

(51) Int. Cl.

| | |
|---|---|
| ***E21B 33/13*** | (2006.01) |
| ***E21B 33/12*** | (2006.01) |
| ***E21B 10/62*** | (2006.01) |
| ***E21B 29/00*** | (2006.01) |

(52) U.S. Cl.

CPC ..... *E21B 33/12* (2013.01); *E21B 10/62* (2013.01); *E21B 29/00* (2013.01); *E21B 33/13* (2013.01)

(58) Field of Classification Search

CPC ..... E21B 33/12; E21B 10/62; E21B 29/00; E21B 33/13; E21B 10/66

See application file for complete search history.

(56) References Cited

U.S. PATENT DOCUMENTS 2,381,929 A * 8/1945 Schlumberger ..... E21B 43/112 166/55.1
2,526,695 A * 10/1950 Schlumberger ..... E21B 43/112 166/55.1
3,419,089 A * 12/1968 Venghiattis ..... E21B 43/116 175/4.57
5,746,279 A 5/1998 Havlinek et al.
6,772,839 B1 8/2004 Bond
7,905,286 B2 * 3/2011 Moody ..... E21B 33/138 166/298
8,118,099 B2 * 2/2012 Moody ..... E21B 49/00 166/298

(Continued)

OTHER PUBLICATIONS

Singh, Pratyush et al., "Introduction to an Effective Workover Method to Repair Casing Leak", SPE-194654-MS, Society of Petroleum Engineers, Apr. 2019 (7 pages).

(Continued)

*Primary Examiner* — Steven A MacDonald

(74) *Attorney, Agent, or Firm* — Osha Bergman Watanabe & Burton LLP

(57) ABSTRACT

An apparatus includes a drill bit having a frangible drive shaft, a thread cutting surface formed on an outer surface of the drill bit, a conical swage formed on the drill bit, the conical swage having a conical shape, and a seal plug coupled to the drill bit, the seal plug removable from the drill bit. A method includes penetrating an inner surface and an outer surface of the casing with a drill point of the drill bit thereby forming a hole, threadingly engaging the seal plug with the hole wall, disengaging the seal plug from a drive shaft of the drill bit assembly, retracting the drill bit assembly through the seal plug, and engaging an outer surface of a conical swage with an inner surface of the seal plug and radially expanding the seal plug as the conical swage is retracted through the hole wall, thereby sealing the hole.

20 Claims, 7 Drawing Sheets

(56) References Cited

U.S. PATENT DOCUMENTS

2001/0010784 A1* 8/2001 Giebmanns ..... B23B 51/02
408/214

OTHER PUBLICATIONS

Ansari, Arsalan A. et al., "Innovative Planning and Remediation Techniques for Restoring the Well Integrity by Curing High Annulus-B Pressure and Zonal Communication", IPTC-18894-MS, International Petroleum Technology Conference, Nov. 2016 (24 pages).
International Search Report and Written Opinion of the International Searching Authority issued in corresponding International Application No. PCT/US2020/053939, dated May 18, 2021 (12 pages).

* cited by examiner

DOWNHOLE DRILL-INJECT AND PLUG TOOL

BACKGROUND

A pipe or tubular that is positioned in a well is commonly referred to as casing. Casing is used in, for example, water wells to seal and support the sides of the drilled well. In the oil and gas industry, casing is similarly lowered into a drilled hole or wellbore to support and stabilize the well. The casing may be cemented in place to provide structural integrity to the well.

Casing annular leaks may compromise well integrity. Casing leaks may occur due to poor cement, long term casing corrosion, or casing damage caused by intervention activities. If the casing annular leak is not repaired, then the well will often have to be abandoned and a new well drilled. In the oil and gas industry, one example of a casing leak failure mode is the migration of hydrocarbons to surface through microchannels in the cement. In order to repair cement, access to the failed area is required. Traditionally, access to the cement that secures the casing in place is often obtained through a perforation through the casing such that a repair fluid or solution (resin, cement, etc.) may be injected into the cement. Once repair of the cement behind the casing has occurred, then another operation is performed to seal the perforation made in the casing. Options to seal the perforation made in the casing are limited. A common solution to seal the perforation in the casing is to set an expandable solution across the holes. This procedure may be time consuming and may reduce the internal diameter of the casing due to the expandable solution applied to an inner surface of the casing.

SUMMARY

In one aspect, embodiments disclosed herein relate to apparatus and methods for perforating a casing, injecting a fluid, and sealing the perforations or holes in a single operation with a single apparatus.

In one aspect, embodiments disclosed herein relate to an apparatus that includes a drill bit having a frangible drive shaft, a thread cutting surface formed on an outer surface of the drill bit, a conical swage formed on the drill bit, the conical swage having a conical shape sloping down toward the frangible drive shaft, and a seal plug coupled to the drill bit, the seal plug removable from the drill bit.

In another aspect, embodiments disclosed herein relate to a drill bit assembly including a drill bit having a drill point and drive shaft, a conical swage formed on the drill bit between the drill point and the drive shaft, the conical swage having a conical shape sloping down toward the drive shaft, and a seal plug removably coupled to the threaded drill bit, the seal plug comprising an outer surface having a self-cutting thread.

In another aspect, embodiments disclosed herein relate to a method that includes rotating a drill bit assembly against a casing, the drill bit assembly having a drill bit with a seal plug and a conical swage, penetrating an inner surface and an outer surface of the casing with a drill point of the drill bit thereby forming a hole, engaging an outer surface of the seal plug with a hole wall defining the hole via a thread, threadingly engaging the seal plug with the hole wall, disengaging the seal plug from a drive shaft of the drill bit assembly when the seal plug is threadingly engaged with the hole wall, retracting the drill bit assembly through the seal plug threadingly engaged with the hole wall, and engaging an outer surface of the conical swage with an inner surface of the seal plug and radially expanding the seal plug as the conical swage is retracted through the hole wall, thereby sealing the hole.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
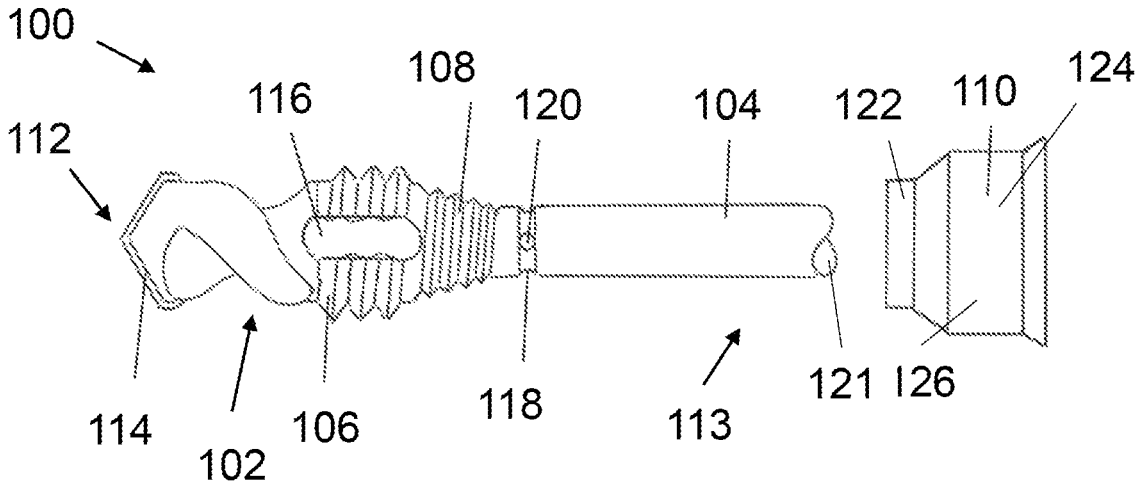
FIG. 1 is an exploded view of a drill bit assembly in accordance with embodiments disclosed herein.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures.

Embodiments disclosed herein are directed to an apparatus that may be used for repairing casing annular leaks. The apparatus includes components for perforating the casing, injecting a fluid, and sealing the perforations or holes in a single operation as opposed to distinct operations. The apparatus may be referred to herein as a "drill-inject-plug assembly" or simply the "drill bit assembly." The drill-inject-plug assembly may include, for example, (1) a drill bit, such as a steel/masonry drill bit; (2) a thread cutter or swage; and (3) a seal plug. Additionally, embodiments disclosed herein relate to a method of (1) drilling a hole in the casing; (2) threading a seal plug in the drilled hole and optionally performing injection operations; and (3) sealing the plug by permanent thread/swaging of the seal plug, wherein the drilling, threading and injecting, and sealing are performed with a single tool assembly as a single continuous operation. In one or more embodiments the method may be used to repair a casing annular leak.

In accordance with one or more embodiments disclosed herein, the drill-inject-plug assembly drills a hole of required size through a casing, tubular, tubing, etc. and into a cement material behind the casing. Although the term casing is used herein, one of ordinary skill in the art will appreciate that a tubular, tubing, pipe, or any other cylindrical or other shaped hollow component may be substituted for a casing without departing from the scope of embodiments disclosed herein. Once the drill has passed through the casing, a metallic seal plug is threaded into the drilled casing hole. In accordance with one or more embodiments, the seal plug is permanently threaded into the drilled casing hole. A fluid, such as a repair fluid, may then be injected through the drill bit assembly as required. To seal the casing hole, the drill bit assembly is rotated and retracted such that the drill bit permanently swages the seal plug and threads into the seal plug. Once the seal plug is swaged, a drive shaft of the drill-inject-plug assembly shears off leaving the drill hole permanently plugged and sealed.

Referring to FIG. 1, a drill bit assembly 100 in accordance with embodiments of the present disclosure is shown in an exploded view. The drill bit assembly 100 includes a drill bit 102 with a drive shaft 104. A thread cutting surface 106 is formed on an outer surface of the drill bit 102. The drill bit assembly 100 further includes a conical swage 108 formed on the drill bit 102. The conical swage 108 includes a conical shape that slopes downward toward the drive shaft 104. The draft shaft 104 may have a narrower diameter section proximate the conical swage 108, thereby forming a shear neck 118. The shear neck 118 has a smaller diameter than an outer diameter of the drive shaft 104 to provide a location at which the drive shaft 104 may be sheared or broken off from the drill bit assembly 100. Thus, in accordance with one or more embodiments the drive shaft 104 may be a frangible drive shaft.

Figure 2:
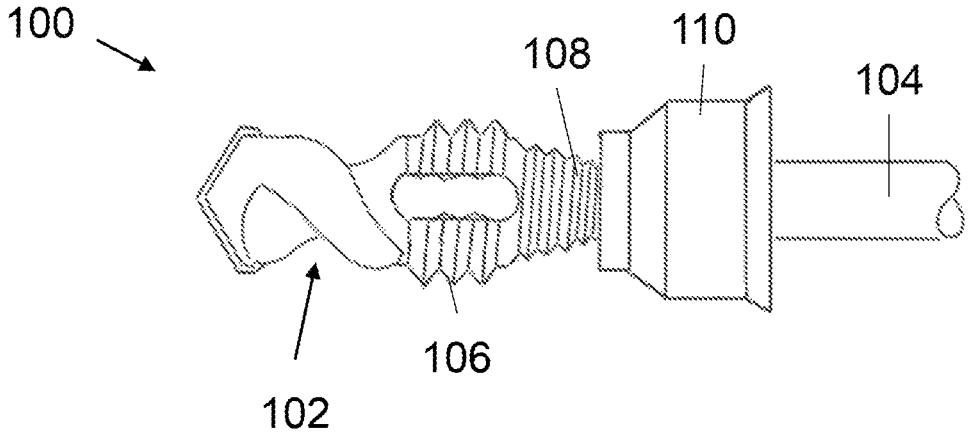
FIG. 2 is a plan view of the drill bit assembly of FIG. 1 in accordance with embodiments disclosed herein.
Figure 10:
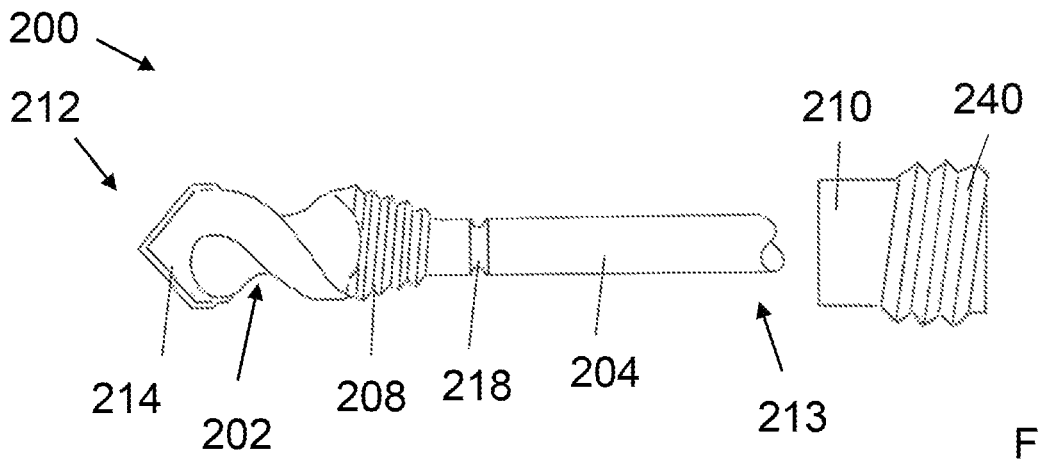
FIG. 10 is an exploded view of a drill bit assembly in accordance with embodiments disclosed herein.

A seal plug 110 is coupled to the drill bit 102, as shown in FIG. 2. The seal plug 110 may be a tubular component that is configured to engage the hole formed in the casing by the drill bit 102, as discussed in detail below. The seal plug 110 may be coupled to the drill bit 102 around the drive shaft 104. The seal plug 110 may have a first section 122 and a second section 124, wherein the first section has a smaller outer diameter than an outer diameter of the second section 124. The seal plug 110 may also include a tapered outer surface 126 between the first section 122 and the second section 124. In one or more embodiments, the seal plug 110 may be coupled to the drill bit 102 with a shear key (not shown), as shown in FIG. 2. Thus, the seal plug 110 is removable from the drill bit 102 by shearing the shear key (not shown) to separate the seal plug 110 from the drill bit 102. In some embodiments, an outer surface of the seal plug 110 may be a plain diameter metallic outer surface, as shown in FIG. 1. In other words, the outer diameter of the seal plug 110 may be threadless and have a constant or constantly increasing/decreasing diameter. In one or more embodiments, the outer surface of the seal plug 110 may be a threaded surface. For example the outer surface of the seal plug 110 may include a self-cut conical thread, such as a National Pipe Thread (NPT) thread, as shown in FIG. 10.

Referring still to FIG. 1, in accordance with one or more embodiments, the drill bit assembly 100 may also include an injection port 120. The injection port 120 may be in fluid communication with a fluid flow channel 121 inside the drive shaft. For example, the drive shaft 120 may be a hollow cylinder and the injection port 120 may be located on the drive shaft 104 to provide fluid communication from inside the drive shaft 104 to outside the drive shaft 104 through the injection port 120. The injection port 120 may be disposed at a location along the drill bit assembly 100 to allow for injection of a fluid from an end of the drive shaft 104 located inside a casing to a location outside of the casing when the drill bit assembly has drilled through the casing, as discussed in more detail below. For example, as shown in FIG. 1, the injection port 120 may be located proximate the conical swage 108 between the conical swage 108 and the drive shaft 104. In one or more embodiments, the injection port 120 may be located in the shear neck 118.

In accordance with embodiments of the present disclosure, the drill bit 102 includes a first end 112 having a threaded outer surface 106 with a hardened drill point 114 and a second end 113 having the drive shaft 104. The hardened drill point 114 is configured to contact and drill through a casing, tubular, or other hollow structure by rotation of the drill bit assembly 100 about a central axis of the drill bit 102 or drive shaft 104. One of ordinary skill in the art will appreciate that the casing may be formed from metal, alloys, cement, or other materials known in the art. Thus, in one or more embodiments, the drill bit 102 may be a metal or masonry drill bit.

The thread cutting surface 106 is disposed axially adjacent the hardened drill point 114. The thread cutting surface 106 facilitates the drill bit assembly 100 drilling through the casing and provides a cut thread on a hole wall of the hole formed in the casing by the drill bit assembly 100. As will be discussed in detail below, the cut thread on the hole wall of the casing is configured to engage with an outer surface of the seal plug 110. In one or more embodiments, the thread cutting surface 106 of the drill bit 102 may be a simple v-thread. In one or more embodiments, an outer diameter of the thread cutting surface 106 is approximately equal to a maximum outer diameter (e.g., the outer diameter of the second section 124) of the seal plug 110. In one or more embodiments, the outer diameter of the thread cutting surface 106 is less than the maximum outer diameter (e.g., the outer diameter of second section 124) of the seal plug 110.

In some embodiments, a bypass relief 116 may be formed in the thread cutting surface 106 to allow for fluid flow past the thread cutting surface 106, as discussed below. For example, as shown in FIG. 1, a longitudinal groove or channel may be formed in the drill bit assembly 100 extending along a length of the drill bit 102 from a first end of the thread cutting surface 106 to a second end of the thread cutting surface 106 such that a length of the longitudinal groove extends greater than an entire length of the thread cutting surface 106.

The conical swage 108 is disposed axially adjacent the thread cutting surface 106, between the thread cutting surface 106 and the drive shaft 104. An outer diameter of the conical swage 108 decreases along a length of the drill bit assembly 100 in a direction from the thread cutting surface 106 toward the drive shaft 104. In one or more embodiments, the conical swage 108 may be a conical seal thread such as National Pipe Thread (NPT) taper type thread. In accordance with embodiments disclosed herein, a minimum outer diameter of the conical swage 108 is less than a minimum inner diameter of the seal plug 110. Further, an outer diameter of the conical swage 108 along a length of the conical swage 108 (i.e., at a location not coincident with the minimum outer diameter of the conical swage 208) is greater than the minimum inner diameter of the seal plug 110. Thus the maximum diameter of the conical swage 108 is also greater than the minimum inner diameter of the seal plug 110.

Referring now to FIGS. 3-9, the stages of operation of the drill bit assembly 100 of FIGS. 1 and 2 will now be described in sequence in accordance with embodiments disclosed herein. The drill bit assembly 100 may be coupled to or installed in a running tool (not shown) and lowered into a casing or tubular to a location for performing, for example, a repair operation of the casing or the supporting material outside of the casing, such as cement. The running tool (not shown) may be configured to run one or more drill bit assemblies 100 down hole to perform one or more than one perforation/threading and injecting/sealing operations.

Figure 3:
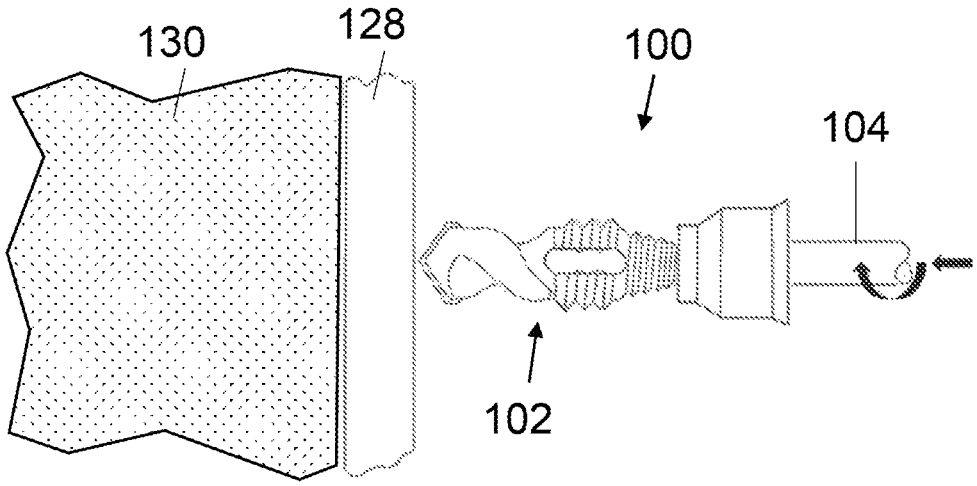
FIGS. 3-9 show stages of operation of the drill bit assembly of FIG. 1 in sequence in accordance with embodiments disclosed herein.

The drill bit assembly 100 may be positioned in a generally perpendicular direction with respect to an inner surface of the casing 128, as shown in FIG. 3. In accordance with embodiments disclosed herein, the casing 128 may be cemented in place such that a cement material 130 abuts an outer surface of the casing 128. The drill bit assembly 100 is rotated, for example in a clockwise direction, about a central axis of the drill bit 102 or drive shaft 104, as the drill bit assembly 100 is advanced toward the casing wall, as indicated by the arrows.

Figure 4:
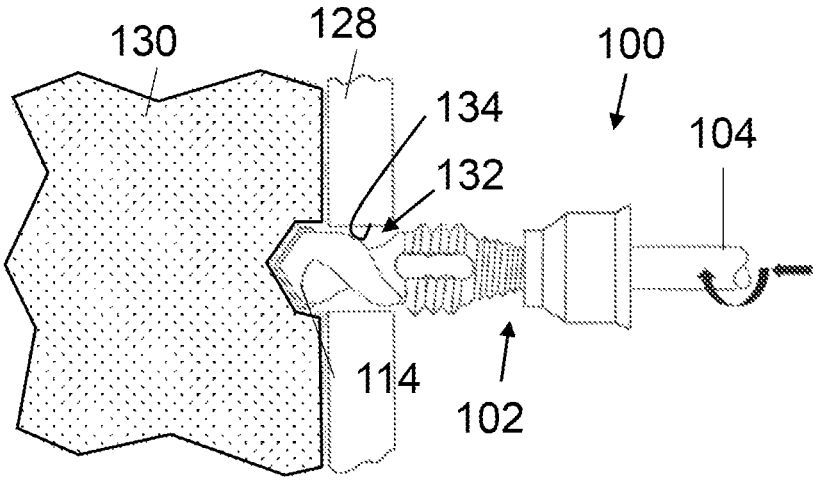
Figure 5:
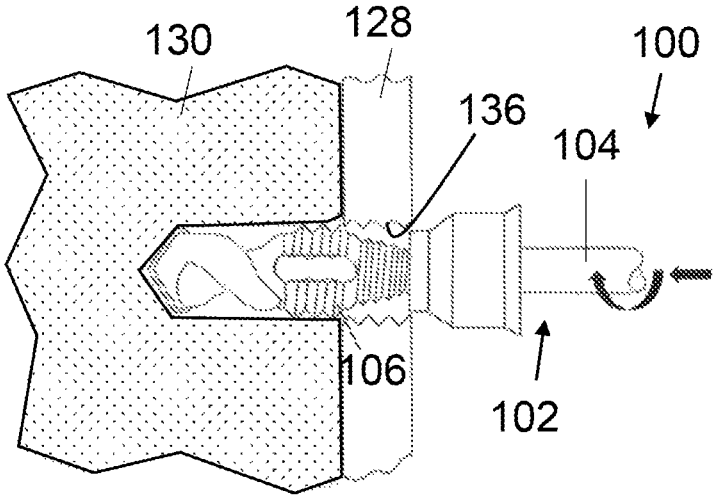

As the drill bit assembly 100 is rotated, the hardened drill point 114 of the drill bit 102 engages with the casing 128 and penetrates through the casing 128, i.e., penetrating from an inner surface of the casing 128 through the outer surface of the casing 128, and into the cement material 130, as shown in FIG. 4. The drill bit 102 forms a hole or perforation 132 in the casing 128 having a hole wall 134 (i.e., the hole wall 134 defines the hole 132). As the drill bit assembly 100 advances through the hole 132 while rotating, the thread cutting surface 106 of the drill bit assembly 100 engages the hole wall 134 defining the hole 132 and cuts a thread 136 in the hole wall 134, as shown in FIG. 5.

Figure 6:
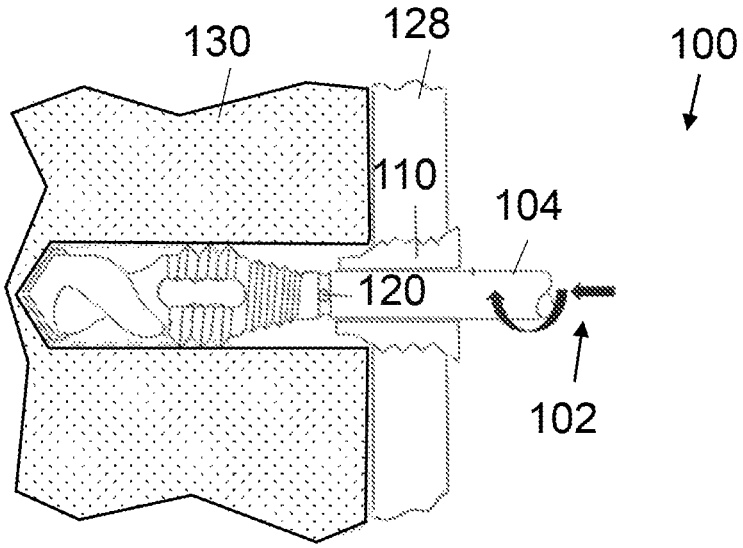

The drill bit assembly 100 continues to advance though the hole 132 while rotating, until the outer surface of the seal plug 110 contacts and engages the thread 136 of hole wall 134 of the hole 132, as shown in FIG. 6. As the drill bit assembly 100 is rotated and advanced, the seal plug 110 is threaded into the casing hole 132. When the seal plug 110 is fully inserted into the hole 132, the shear key (not shown) coupling the seal plug 110 to the drill bit assembly 100 will shear, thereby allowing the seal plug 110 to separate from the drive shaft 104 and remain fully engaged with the casing 128. The drill bit 102 may be further advanced into the cement 130 until the injection port 120 passes through the seal plug 110 and is positioned outside the outer surface of the casing 128.

Figure 7:
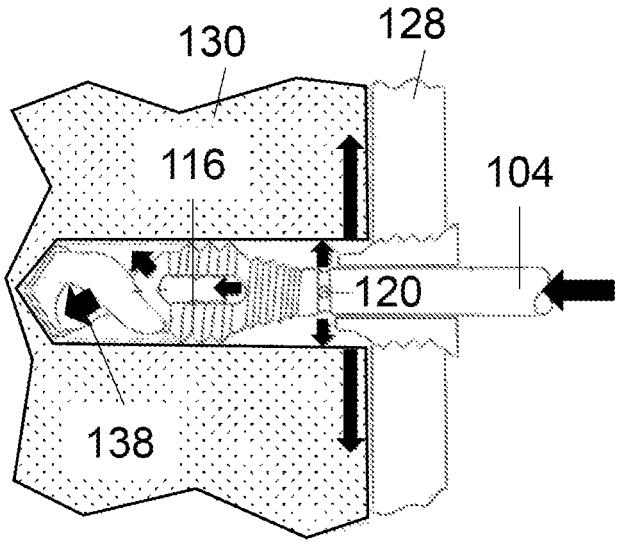

After the drill bit assembly 100 has been fully advanced through the hole 132 of the casing, such that the seal plug 110 is engaged with the hole wall 134 of the casing 128 and the injection port 120 is outside the casing 128, rotation and advancement of the drill bit 102 may be stopped. Then, an injection fluid is pumped through the drive shaft 104 and out the injection port 120 into the cement 130 or surrounding area of the casing 128, as shown in FIG. 7. The injection fluid may be a repair fluid, such as, a sealant, cement, resins, or other repair fluids known in the art. In one or more embodiments, the fluid may flow along the drilled hole in the cement 130 radially about the drill bit assembly 100 from the injection port 120 and axially along the drill bit assembly 100 (i.e., radially out from the casing 128) though the bypass relief 116 and drill flutes 138 of the drill bit 102.

Figure 8:
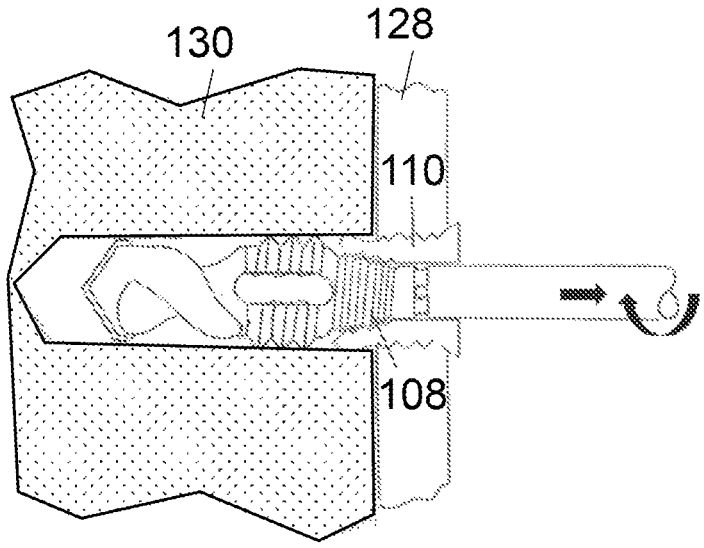

Rotation of the drill bit 102 via the drive shaft 104 may be restarted and the drill bit 102 may be retracted back through the hole 132, as shown in FIG. 8. In one or more embodiments, the drill bit 102 is rotated in the same direction as it was rotated as the drill bit assembly 100 was advanced into and through the casing 128 (e.g., a clockwise direction). As the drill bit 102 is retracted back into the seal plug 110, the outer surface of the conical swage 108 engages the inner surface of the seal plug 110. The conical swage 108 will thread into the seal plug 110 as the drill bit 102 is retracted and rotated and cause the seal plug 110 to radially expand. Because the rotational direction of the drill bit 102 is the same as when the drill bit assembly 100 was advanced into and through the casing 128, the seal plug 110 will be pulled tighter into the hole 132 and radially expanded at the same time, thereby creating a full metal-to-metal seal. Thus, when the conical swage 108 is fully engaged with the seal plug 110, thereby radially expanding the seal plug 110 into the hole wall 132 of the casing 128, a pressure retaining seal may be provided.

Figure 9:
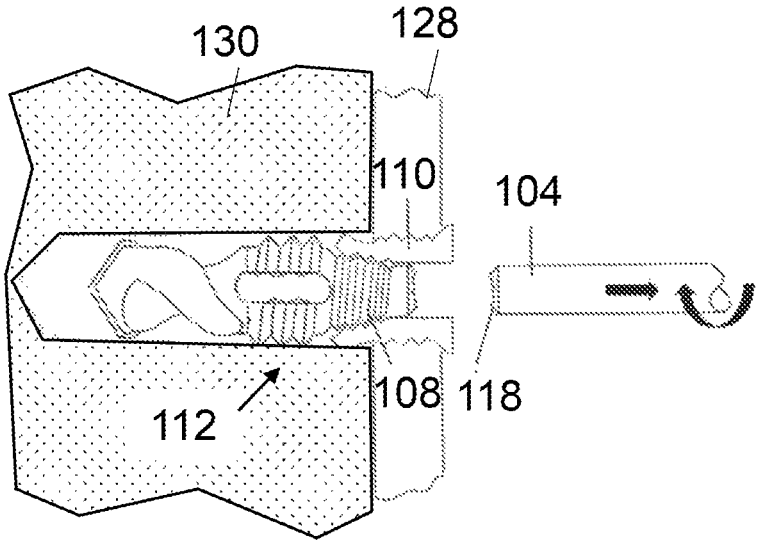

Once the conical swage 108 is fully wedged within the seal plug 110, further retraction and rotation of the drive shaft 104 will cause the drive shaft 104 to break and separate from the drill bit 102, as shown in FIG. 9. For example, retraction and rotation of the drive shaft 104 after the conical swage 108 is fully wedged within the seal plug 110 may cause the shear neck 118 to fail, shearing off the drive shaft 104, and leaving the first end 112 of the drill bit 102 permanently installed within the casing 128. An operation in accordance with that described with respect to FIGS. 3-9, such as a repair procedure, may allow for the casing to be perforated and the hole permanently plugged and sealed with no or minimal reduction in the inner diameter of the casing/tubular, as shown in FIG. 9.

Referring to FIG. 10, a drill bit assembly 200 in accordance with embodiments of the present disclosure is shown in an exploded view. The drill bit assembly 200 is similar to the drill bit assembly 100 of FIGS. 1 and 2; however the drill bit assembly 200 does not include a thread cutting surface, the seal plug 210 includes a self-cutting thread, and the drill bit assembly includes an injection flow path external to the drive shaft, as discussed below.

As shown in FIG. 10, in accordance with embodiments disclosed herein, the drill bit assembly 200 includes a drill bit 202 with a drive shaft 204. The drill bit assembly 200 includes a conical swage 208 formed on the drill bit 202. The conical swage 208 includes a conical shape that slopes downward toward the drive shaft 204. The draft shaft 204 may have a narrower diameter section proximate the conical swage 208, thereby forming a shear neck 218. The shear neck 218 has a smaller diameter than an outer diameter of the drive shaft 204 to provide a location at which the drive shaft 204 may be sheared or broken off from the drill bit assembly 200. Thus, in accordance with one or more embodiments the drive shaft 204 may be a frangible drive shaft.

Figure 11:
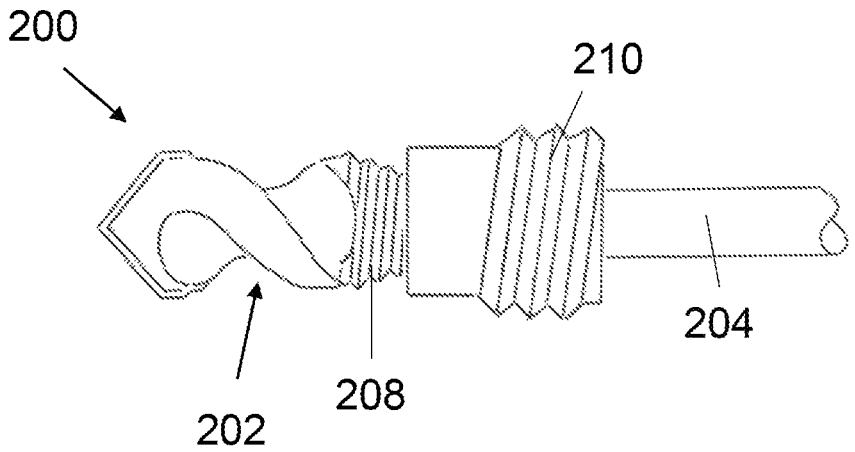
FIG. 11 is a plan view of the drill bit assembly of FIG. 10 in accordance with embodiments disclosed herein.

A seal plug 210 is coupled to the drill bit 202, as shown in FIG. 11. The seal plug 210 may be a tubular component that is configured to engage the hole formed in the casing by the drill bit 202, as discussed below. The seal plug 210 may be coupled to the drill bit 202 around the drive shaft 204. In one or more embodiments, the seal plug 210 may be coupled to the drill bit 202 with a shear key (not shown), as shown in FIG. 11. Thus, the seal plug 210 is removable from the drill bit 202 by shearing the shear key (not shown) to separate the seal plug 210 from the drill bit 202. In one or more embodiments, the outer surface of the seal plug 110 may include a threaded surface 240. For example, the outer surface of the seal plug 210 may include a self-cutting thread, such as a National Pipe Thread (NPT) thread. Thus, the seal plug 210 is configured to cut a thread in the hole wall of the hole as it passes through the hole, as discussed below. In one or more embodiments, the self-cut thread may be a conical thread. In some embodiments, the threaded surface 240 may be located proximate a first end of the seal plug 210, while an outer surface of the seal plug 210 proximate a second end of the seal plug 210 may include a plain diameter or threadless surface.

In accordance with embodiments of the present disclosure, the drill bit 202 includes a first end 212 having a hardened drill point 214 and a second end 213 having the drive shaft 204. The hardened drill point 214 is configured to contact and drill through a casing, tubular, or other hollow structure by rotation of the drill bit assembly 200 about a central axis of the drill bit 202 or drive shaft 204. One of ordinary skill in the art will appreciate that the casing may be formed from metal, alloys, cement, or other materials known in the art. Thus, in one or more embodiments, the drill bit 202 may be a metal or masonry drill bit.

The conical swage 208 is disposed axially adjacent the hardened drill point 214, between the drill point 214 and the drive shaft 204. An outer diameter of the conical swage 208 decreases along a length of the drill bit assembly 200 in a direction from the drill point 214 toward the drive shaft 204. In one or more embodiments, the conical swage 208 may be a conical seal thread such as National Pipe Thread (NPT) taper type thread. In accordance with embodiments disclosed herein, a minimum outer diameter of the conical swage 208 is less than a minimum inner diameter of the seal plug 210. Further, an outer diameter of the conical swage 208 along a length of the conical swage 208 (i.e., at a location not coincident with the minimum outer diameter of the conical swage 208) is greater than the minimum inner diameter of the seal plug 210. Thus, the maximum diameter of the conical swage 208 is also greater than the minimum inner diameter of the seal plug 210.

Referring now to FIGS. 12-18, the stages of operation of the drill bit assembly 200 of FIGS. 10 and 11 will now be described in sequence in accordance with embodiments disclosed herein. The drill bit assembly 200 may be coupled to or installed in a running tool (not shown) and lowered into a casing or tubular to a location for performing, for example, a repair operation of the casing or the supporting material outside of the casing, such as cement. The running tool (not shown) may be configured to run one or more drill bit assemblies 200 down hole to perform one or more than one perforation/threading and injecting/sealing operations.

Figure 12:
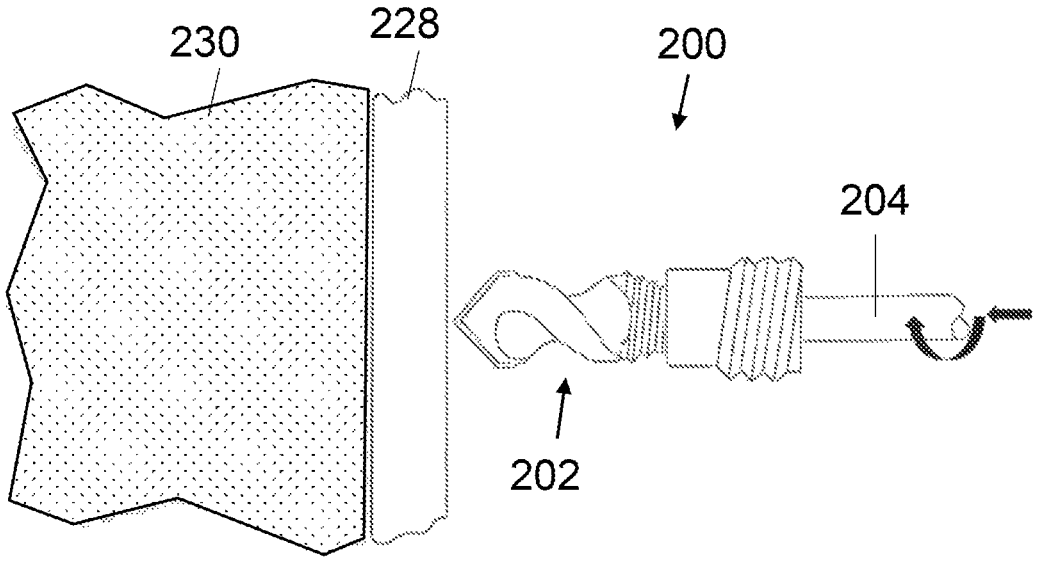
FIGS. 12-18 show stages of operation of the drill bit assembly of FIG. 10 in sequence in accordance with embodiments disclosed herein.

The drill bit assembly 200 may be positioned in a generally perpendicular direction with respect to an inner surface of the casing 228, as shown in FIG. 12. In accordance with embodiments disclosed herein, the casing 228 may be cemented in place such that a cement material 230 abuts an outer surface of the casing 228. The drill bit assembly 200 is rotated, for example in a clockwise direction, about a central axis of the drill bit 202 or drive shaft 204, as the drill bit assembly 200 is advanced toward the casing wall, as indicated by the arrows.

Figure 13:
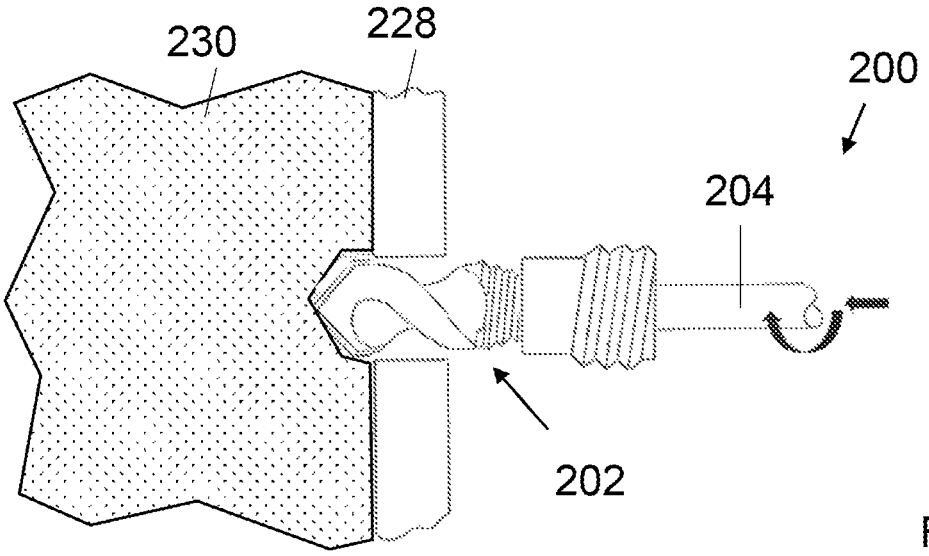
Figure 14:
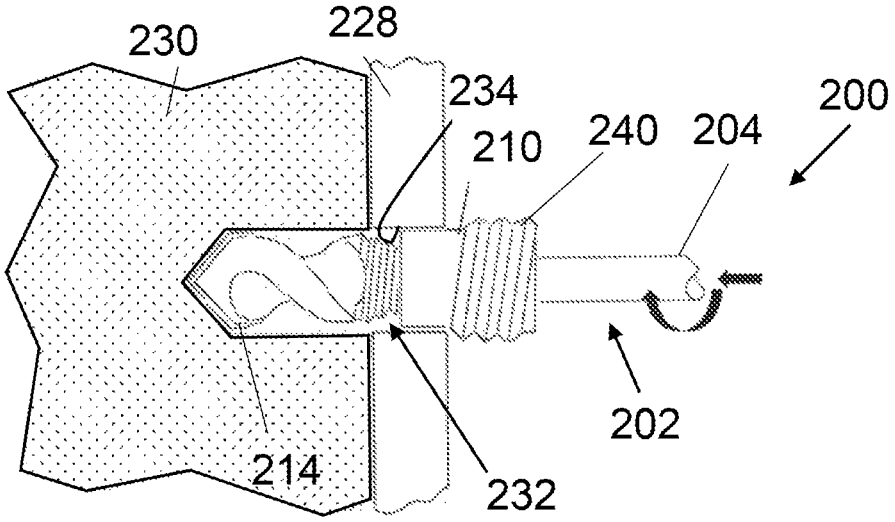

As the drill bit assembly 200 is rotated, the hardened drill point 214 of the drill bit 202 engages with the casing 228 and penetrates through the casing 228, i.e., penetrating from an inner surface of the casing 228 through the outer surface of the casing 228, and into the cement material 230, as shown in FIG. 13. The drill bit 202 forms a hole or perforation 232 in the casing 228 having a hole wall 234 (i.e., the hole wall 234 defines the hole 232 in the casing 228). As the drill bit assembly 200 advances through the hole 232 while rotating, the second end of the seal plug 210 enters the hole 232 in the casing and centralizes the seal plug 210 within the hole 232 before the threaded surface 240 of the first end of the seal plug 210 engages the hole 232, as shown in FIG. 14.

Figure 15:
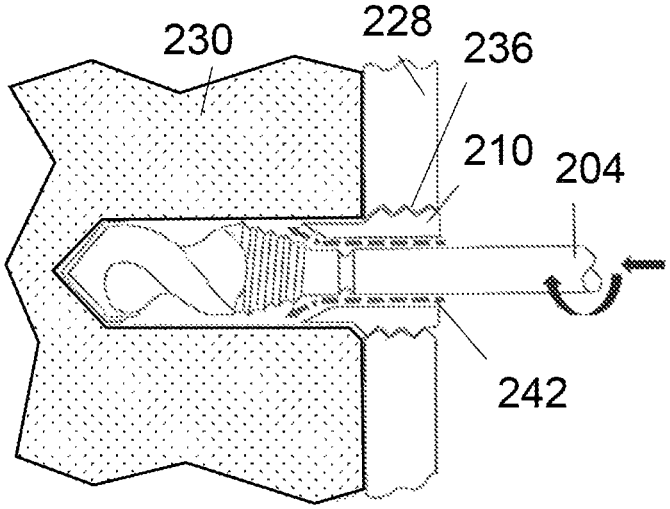

The drill bit assembly 200 continues to advance though the hole 232 while rotating, until the threaded surface 240 of the seal plug 210 contacts and engages the hole wall 234 of the hole 232, as shown in FIG. 15. As the drill bit assembly 200 is rotated and advanced, the seal plug 210 is threaded into the casing hole 232. More specifically, the seal plug 210 cuts a thread 236 into the hole wall 234 of the casing. When the seal plug 210 is fully inserted into the hole 232, the shear key (not shown) coupling the seal plug 210 to the drill bit assembly 200 will shear, thereby allowing the seal plug 210 to separate from the drive shaft 204 and remain fully engaged with the casing 228. An annular space 242 is formed between the drive shaft 204 and the seal plug 210. As the drill bit assembly 200 is further advanced, an fluid injection flow path, as indicated by the arrows in FIG. 15, along the drive shaft 204 in the annular space 242 between the drive shaft 204 and the seal plug 210 from inside the casing 228 to outside the casing 228 is provided.

Figure 16:
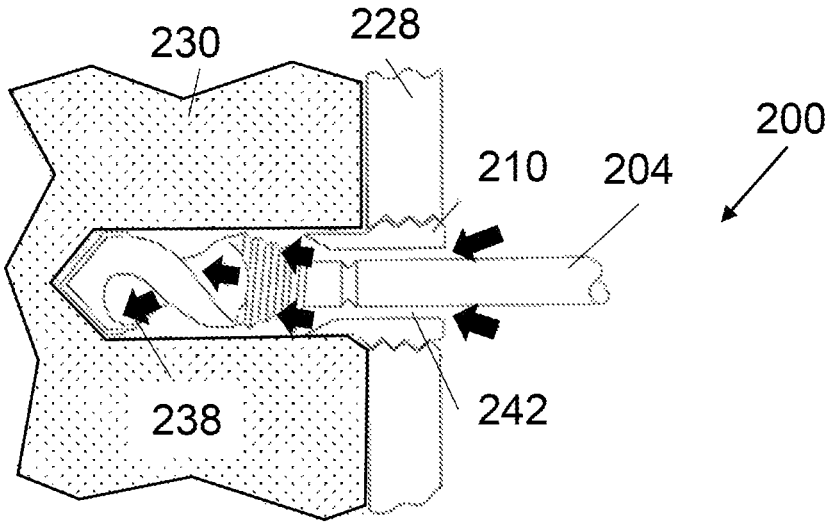

After the drill bit assembly 200 has been fully advanced through the hole 232 of the casing 228, such that the seal plug 210 is engaged with the hole wall 234 of the casing 228, rotation and advancement of the drill bit 202 may be stopped. Then, an injection fluid is pumped through the seal plug 210 and into the cement 230 or surrounding area of the casing 228, as shown in FIG. 16. The injection fluid may be a repair fluid, such as, a sealant, cement, or other repair fluids known in the art. In one or more embodiments, the fluid may flow along the outer surface of the drive shaft 204 axially along the drill bit assembly 200 (i.e., radially out from the casing 228) though the drill flutes 238.

Figure 17:
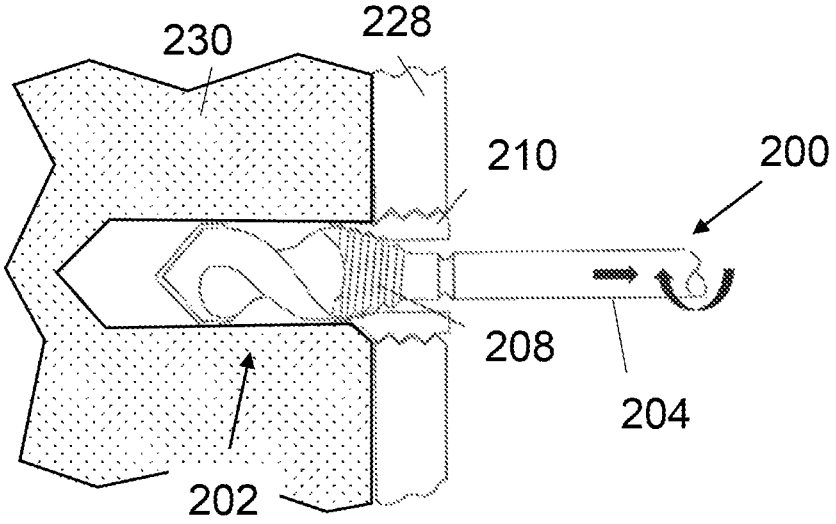

Rotation of the drill bit 202 via the drive shaft 204 may be restarted and the drill bit 202 may be retracted back through the hole 232, as shown in FIG. 17. In one or more embodiments, the drill bit 202 is rotated in the same direction as it was rotated as the drill bit assembly 200 was advanced into and through the casing 228 (e.g., a clockwise direction). As the drill bit 202 is retracted back into the seal plug 210, the outer surface of the conical swage 208 engages the inner surface of the seal plug 210. The conical swage 208 will thread into the seal plug 210 as the drill bit 202 is retracted and rotated and cause the seal plug 210 to radially expand. Because the rotational direction of the drill bit 202 is the same as when the drill bit assembly 200 was advanced into and through the casing 228, the seal plug 210 will be pulled tighter into the hole 232 and radially expanded at the same time, thereby creating a full metal-to-metal seal. Thus, when the conical swage 208 is fully engaged with the seal plug 210, thereby radially expanding the seal plug 210 into the hole wall 232 of the casing 228, a pressure retaining seal may be provided.

Figure 18:
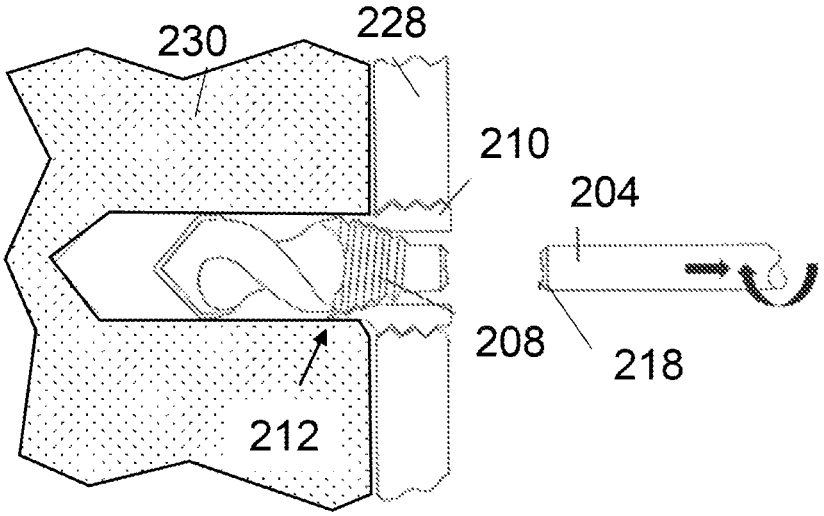

Once the conical swage 208 is fully wedged within the seal plug 210, retraction and rotation on the drive shaft 204 will cause the drive shaft 204 to break and separate from the drill bit 202, as shown in FIG. 18. For example, retraction and rotation on the drive shaft 204 after the conical swage 208 is fully wedged within the seal plug 210 may cause the shear neck 218 to fail, shearing off the drive shaft 204, and leaving the first end 212 of the drill bit 202 permanently installed within the casing 228. An operation in accordance with that described with respect to FIGS. 12-18, such as a repair procedure, may allow for the casing to be perforated and the hole permanently plugged and sealed with no or minimal reduction in the inner diameter of the casing/tubular, as shown in FIG. 18.

Figure 19:
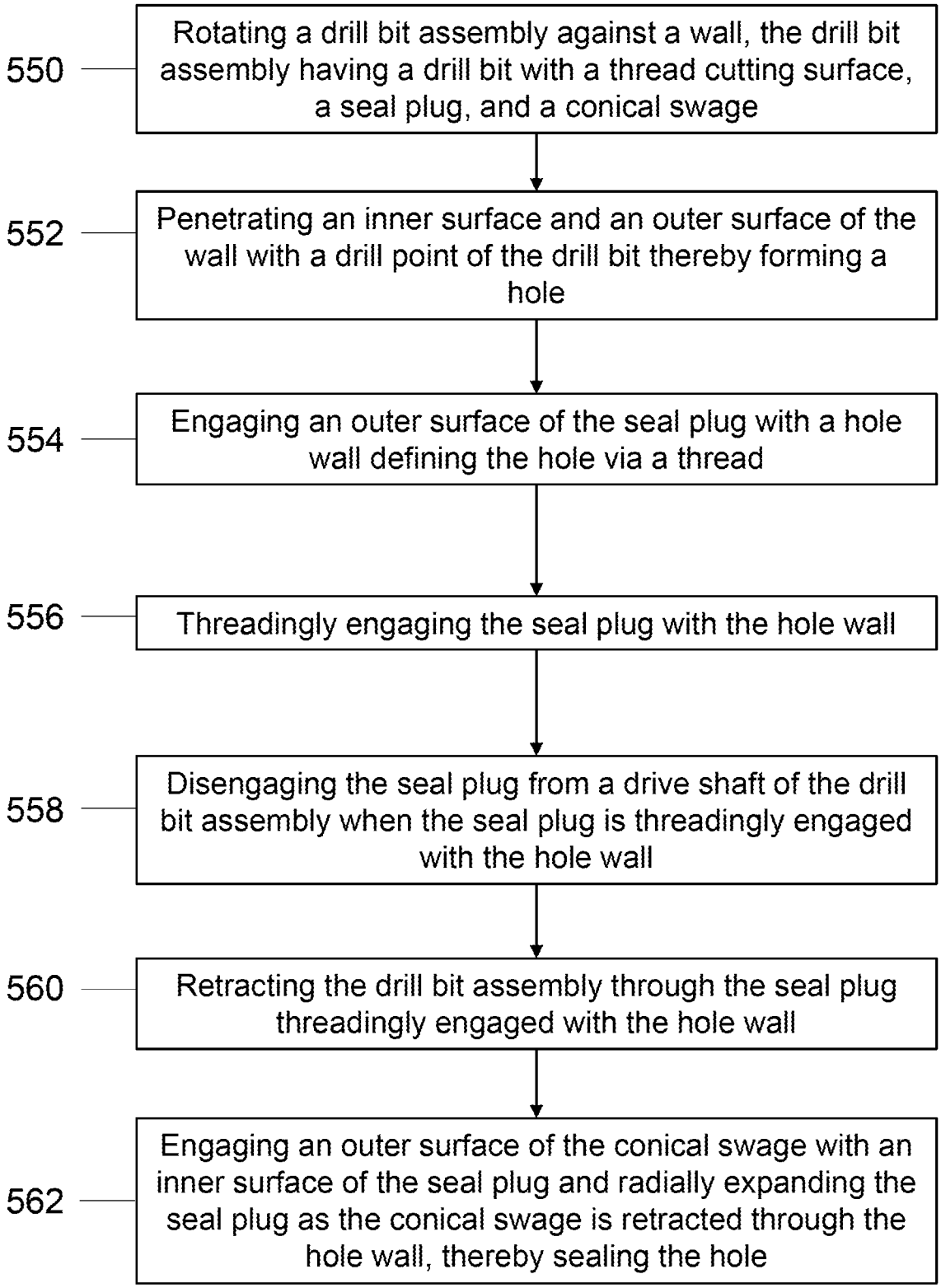
FIG. 19 is a flow chart of a method in accordance with embodiments disclosed herein.

FIG. 19 shows a method in accordance with embodiments disclosed herein. The method in accordance with one or more embodiments disclosed herein provides a method for perforating a casing, injecting a fluid through the perforation, and plugging and sealing the perforation with a single tool. As shown in FIG. 19, with reference to FIGS. 1-18, the method includes rotating a drill bit assembly 100, 200 against a casing 128, 228, the drill bit assembly 100, 200 having a drill bit 102, 202 with a seal plug 110, 210, and a conical swage 108, 208, as shown at 550. The method then includes penetrating an inner surface and an outer surface of the casing 128, 228 with a drill point 114, 224 of the drill bit 102, 202 thereby forming a hole 132, 232, as shown at 552.

As the drill assembly 100, 200 continues to rotate and advance, an outer surface of the seal plug 110, 210 is engaged with a hole wall 134, 234 (the hole wall 134, 234 defining the hole 132, 232 formed by the drill point 114, 214) via a thread, as shown at 554. In one or more embodiments, the outer surface of the seal plug 210 includes a threaded surface 240 having a self-cut thread. The self-cut thread engages the hole wall 234 thereby cutting a thread 236 in the hole wall 234 and threadingly engaging the outer surface of the seal plug 210 with the hole wall, as shown at 556. In one or more embodiments, a thread cutting surface 106 of the drill bit 102 is engaged with the hole wall 134 and a thread 136 is cut in the hole wall 134 as the drill bit assembly 100 advances though the casing. In this embodiment(s), the seal plug 110 is threadedly engaged with the hole wall 134 by threading the seal plug 110 with the thread 136 cut in the hole wall 134, as shown at 556.

After the seal plug 110, 210 is engaged with the hole wall, the seal plug 110, 210 is disengaged from a drive shaft 104, 204 of the drill bit assembly 100, 200, as shown at 558. The drill bit assembly 100, 200 is then retracted through the seal plug 110, 210 engaged with the hole wall 134, 234, as shown at 560. An outer surface of the conical swage 108, 208 engages an inner surface of the seal plug 110, 210 and radially expands the seal plug 110, 210 as the conical swage 108, 208 is retracted through the hole wall 134, 234, thereby sealing the hole 132, 232, as shown at 562. When the conical swage 108, 208 is engaged with, i.e., fully wedged within the seal plug 110, 210, the drive shaft 104, 204 may be sheared from the drill bit assembly 100, 200 by continuing to retract and rotate the drill bit assembly 100, 200, thereby causing a stress on a shear neck 118, 228 formed on the drive shave 104, 204.

The method in accordance with embodiments disclosed herein also includes injecting a fluid, such as a repair fluid, though the casing via the drill bit assembly 100, 200. In one or more embodiments, the fluid may be injected through the drive shaft 104 the fluid exiting an injection port 120 formed in the drill bit assembly 100 when the injection port 120 is positioned outside the outer surface of the casing 128. In other embodiments, the fluid may be injected through the seal plug 210 along the drive shaft 204 in a space 242 between an outer surface of the drive shaft 204 and an inner surface of the seal plug 210.

An apparatus or method in accordance with embodiments disclosed herein may advantageously allow for a single device and a single operation to perform perforation of a casing, injection of a fluid through the perforation, and plugging and sealing of the perforation. An apparatus and method in accordance with embodiments disclosed herein may provide for perforation of the casing, injection through the perforation, and sealing of the perforation with no or minimal reduction in the inner diameter of the casing and without the need for subsequent casing/tubing patch setting.

Further, embodiments disclosed herein provide for a drilled hole in the casing which may advantageously provide for no or minimal deformation damage to the casing which may occur with perforations formed with punches or explosives. Further embodiments disclosed herein may advantageously provide a clean cut hole through the casing and also allow for drilling into and through cement behind the casing. Further, apparatus and methods in accordance with embodiments disclosed herein advantageously provide a self-cut conical thread (e.g., NPT thread) that ensures a seal plug is fully retained in the hole or perforation created and creates a pressure retaining seal. In embodiments where, for example, a sealant is not injected through the casing, a drill bit assembly in accordance with embodiments disclosed herein may provide a fully pressure retaining seal as the drill bit is retracted through the seal plug.

While the method and apparatus have been described with respect to a limited number of embodiments, those skilled in the art, having benefit of this disclosure, will appreciate that other embodiments can be devised which do not depart from the scope as disclosed herein. Accordingly, the scope should be limited only by the attached claims.

What is claimed is:

1. An apparatus comprising:

a drill bit having a frangible drive shaft;

a thread cutting surface formed on an outer surface of the drill bit;

a conical swage formed on the drill bit, the conical swage having a conical shape sloping down toward the frangible drive shaft; and a seal plug coupled to the drill bit, the seal plug removable from the drill bit.

2. The apparatus of claim 1, wherein the seal plug is a tubular component having a plain diameter outer surface.

3. The drill bit assembly of claim 1, wherein the thread cutting surface formed on the outer surface of the drill bit is located between a drill point of the drill bit and the conical swage.

4. The drill bit assembly of claim 1, further comprising a bypass relief formed in the thread cutting surface of the drill bit.

5. The apparatus of claim 1, further comprising an injection port located between the drive shaft and the conical swage, the injection port fluidly coupled to a fluid flow channel inside the drive shaft.

6. A drill bit assembly comprising:

a drill bit having a drill point and a drive shaft;

a conical swage formed on the drill bit between the drill point and the drive shaft, the conical swage having a conical shape sloping down toward the drive shaft; and a seal plug removably coupled to the threaded drill bit, the seal plug comprising an outer surface having a self-cutting thread.

7. The apparatus of claim 6, wherein an outer diameter of the conical swage 208 is greater than a minimum inner diameter of the seal plug.

8. The drill bit assembly of claim 6, wherein the seal plug is a tubular component having a minimum inner diameter greater than an outer diameter of the frangible drive shaft providing an annular space between the frangible drive shaft and the seal plug.

9. A method comprising:

rotating a drill bit assembly against a casing, the drill bit assembly having a drill bit with a seal plug and a conical swage;

penetrating an inner surface and an outer surface of the casing with a drill point of the drill bit thereby forming a hole;

engaging an outer surface of the seal plug with a hole wall defining the hole via a thread;

threadingly engaging the seal plug with the hole wall;

disengaging the seal plug from a drive shaft of the drill bit assembly when the seal plug is threadingly engaged with the hole wall;

retracting the drill bit assembly through the seal plug threadingly engaged with the hole wall; and engaging an outer surface of the conical swage with an inner surface of the seal plug and radially expanding the seal plug as the conical swage is retracted through the hole wall, thereby sealing the hole.

10. The method of claim 9, wherein the engaging the outer surface of the seal plug with the hole wall via the thread comprises engaging a self-cut thread on the outer surface of the seal plug with the hole wall.

11. The method of claim 9, further comprising engaging a thread cutting surface of the drill bit with the hole wall and cutting a thread in the hole wall as the drill bit assembly advances though the casing, and wherein the threadingly engaging the seal plug with the hole wall comprises threading the seal plug with the thread cut in the hole wall.

12. The method of claim 9, further comprising injecting a fluid through the casing and through the seal plug by injecting the fluid through the drive shaft, the fluid exiting an injection port formed in the drill bit assembly when the injection port is positioned outside the outer surface of the casing.

13. The method of claim 12, wherein injecting the fluid through the drive shaft further comprises flowing the fluid through a bypass relief formed in the thread cutting surface and along drill flutes of the drill bit.

14. The method of claim 9, further comprising injecting a fluid through the casing and through the seal plug along the drive shaft in a space between an outer surface of the drive shaft and an inner surface of the seal plug.

15. The method of claim 9, wherein the rotating comprises rotating the drill bit assembly about a central axis of the drill bit.

16. The method of claim 9, further comprising penetrating a cement material disposed proximate the outer surface of the casing.

17. The method of claim 9, further comprising shearing the drive shaft from the drill bit assembly when the conical swage is engaged with the seal plug.

18. The method of claim 9, wherein rotating of the drill bit assembly is stopped while injecting the fluid through the drive shaft.

19. The method of claim 9, further comprising rotating the drill bit assembly while retracting the drill bit and the conical swage.

20. The method of claim 9, wherein engaging the outer surface of the conical swage with the inner surface of the seal plug comprises engaging a threaded surface of the conical swage with an inner surface of the seal plug.

* * * * *